US006364214B1

(12) United States Patent
Sonneville et al.

(10) Patent No.: US 6,364,214 B1
(45) Date of Patent: Apr. 2, 2002

(54) BLOCK BOOT FOR RAILWAY TRACK SYSTEMS

(75) Inventors: Bernard Sonneville, Springfield, VA (US); Anderson Thomas Bray, Jr., Silver Spring, MD (US)

(73) Assignee: Sonneville International Corporation, Alexandria, VA (US)

( * ) Notice: Subject to any disclaimer, the term of this patent is extended or adjusted under 35 U.S.C. 154(b) by 0 days.

(21) Appl. No.: 09/609,311

(22) Filed: Jun. 30, 2000

(51) Int. Cl.[7] ..... E01B 1/00
(52) U.S. Cl. ..... 238/115; 238/109
(58) Field of Search ..... 238/109, 114, 238/115, 116, 117, 382

(56) References Cited

U.S. PATENT DOCUMENTS 3,289,941 A * 12/1966 Sonneville ..... 238/116
4,878,589 A * 11/1989 Webster et al. ..... 215/252
5,551,631 A * 9/1996 Cailliau ..... 238/115
5,713,517 A * 2/1998 Loison ..... 238/2
5,725,149 A * 3/1998 Goossens ..... 238/382
6,283,383 B1 * 9/2001 Blank et al. ..... 238/382

* cited by examiner

*Primary Examiner*—S. Joseph Morano
*Assistant Examiner*—Lars A. Olson
(74) *Attorney, Agent, or Firm*—Wenderoth, Lind & Ponack, L.L.P.

(57) ABSTRACT

The invention pertains to a boot for a railway block or tie. The boot is provided with fins that extend from an internal wall of the boot. The fins serve to space the internal wall from the railway block or tie during pouring and curing of concrete or grout around the boot.

34 Claims, 9 Drawing Sheets

BLOCK BOOT FOR RAILWAY TRACK SYSTEMS

FIELD OF THE INVENTION

The present invention pertains to a boot for receiving a block or tie that supports a rail of a railway track system.

BACKGROUND OF THE INVENTION

Over the last few decades, a number of light rail, metro and railway lines around the world have been equipped with various non-ballasted track systems in order to reduce maintenance costs and increase performance. Certain such systems comprise a block or tie generally made of concrete, a boot generally made of molded rubber that receives the block or tie, and a resilient elastomeric pad placed between the base of the block or tie and the base of the boot. The boot is then encased in concrete or grout. The block or tie as well as a boot wall are sloped in order to permit the replacement of these components without the need to break-up the encasement concrete or grout. While these systems have performed satisfactorily over the years, it became apparent that their dynamic to static stiffness ratio increased as a vertical movement of the block or tie, and therefore the deflection of the resilient pad under dynamic loading, was impeded by an interface between the block or tie and the boot wall. This interface is a phenomenon known as the wedge effect.

A method implemented in the past to decrease the dynamic stiffness of the track system has consisted of first assembling the track system, then lifting the block or tie out of the boot, then installing a second resilient pad on top of the original pad, and then re-inserting the block or tie into the boot on top of the second resilient pad. This method was primarily aimed at reducing the stiffness of the system by increasing the pad thickness, but had the indirect consequence of eliminating the wedge effect within a range determined by the slope of the block or tie and the boot wall, and the thickness of the second resilient pad.

While the use of the second resilient pad eliminated the wedge effect, and thereby decreased the dynamic to static stiffness ratio, it also reduced the. effective embedment depth of the block or tie in the encasement concrete or grout, and thereby negatively affected the lateral resistance of the track. Also, the cost of the steps involved in providing the second resilient pad has limited the implementation of that method to only a few, mostly experimental applications.

SUMMARY OF THE INVENTION

The primary object of the present invention is to eliminate the aforementioned wedge effect while not reducing the lateral resistance of the track.

In accordance with the present invention, there is provided a boot having fins protruding from a wall of the boot. The dimensions of the fins determine the range in which the wedge effect will be eliminated. Elimination of the wedge effect allows free vertical movement of the block or tie, and full designed deflection of the resilient pad under dynamic loading within the predetermined range, once the fins have been crushed or abraded by the block or tie. Accordingly, the dynamic to static stiffness ratio of the track system is reduced, thus enhancing the ability of the track system to meet dynamic to static stiffness ratio limitations that are frequently specified in order to control related noise and vibration transmitted to the environment from the track system.

The present invention eliminates the wedge effect without reducing the effective embedment depth of the block or tie in the encasement concrete or grout, and thereby without negatively affecting the lateral resistance of the track.

The present invention achieves the aforementioned objective in an economic manner through the incorporation of fins into the boot, rather than through the implementation of costly successive construction steps and the addition of a component such as a shim or second pad to the system.

DETAILED DESCRIPTION OF THE PREFERRED EMBODIMENT

Figure 1:
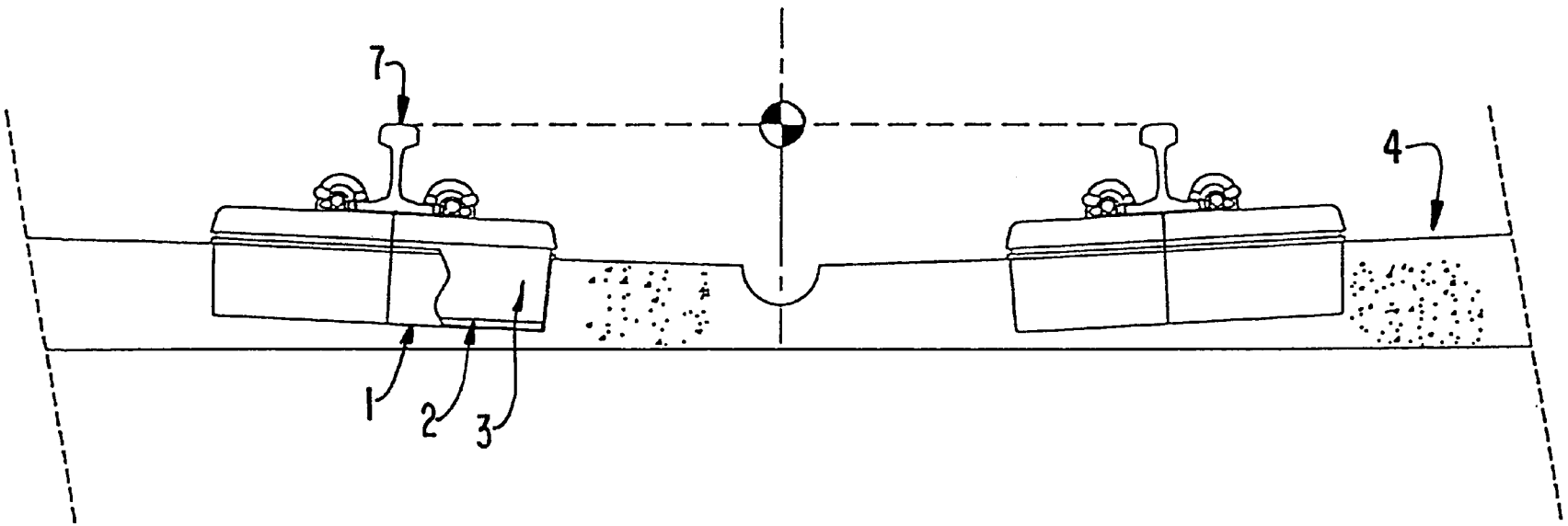
FIG. 1 is a cross sectional view of a first type of a non-ballasted track system.
Figure 2:
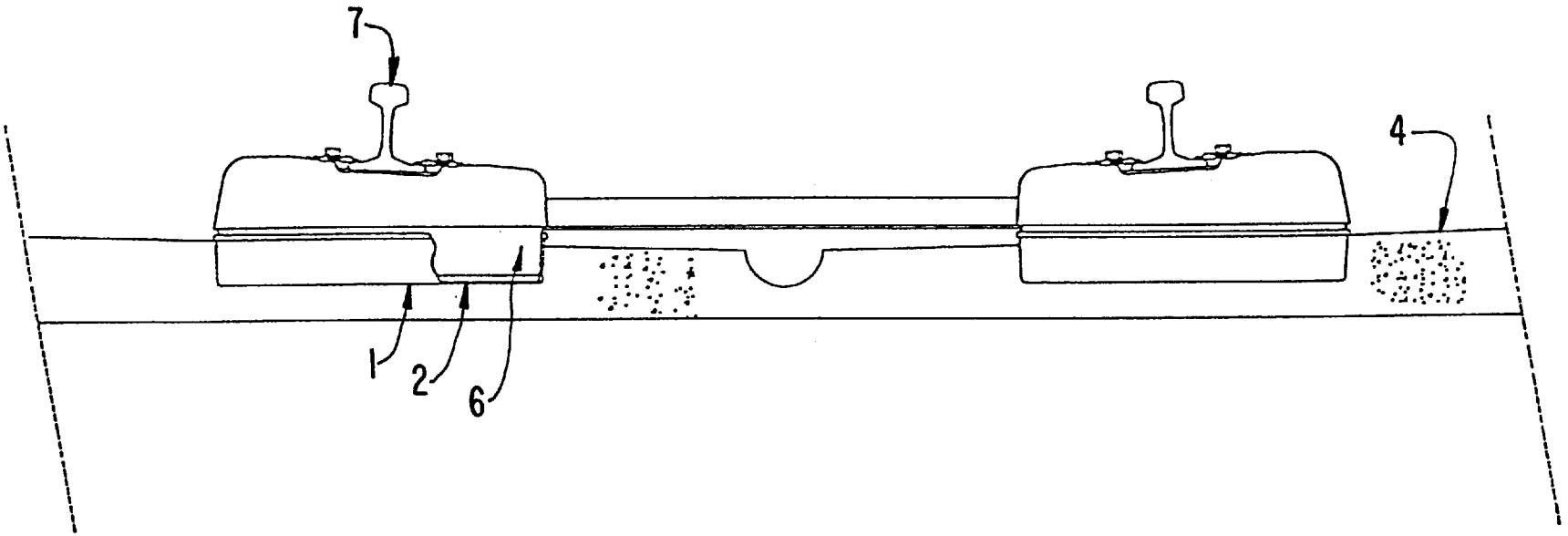
FIG. 2 is a cross sectional view of a second type of a non-ballasted track system.
Figure 3:
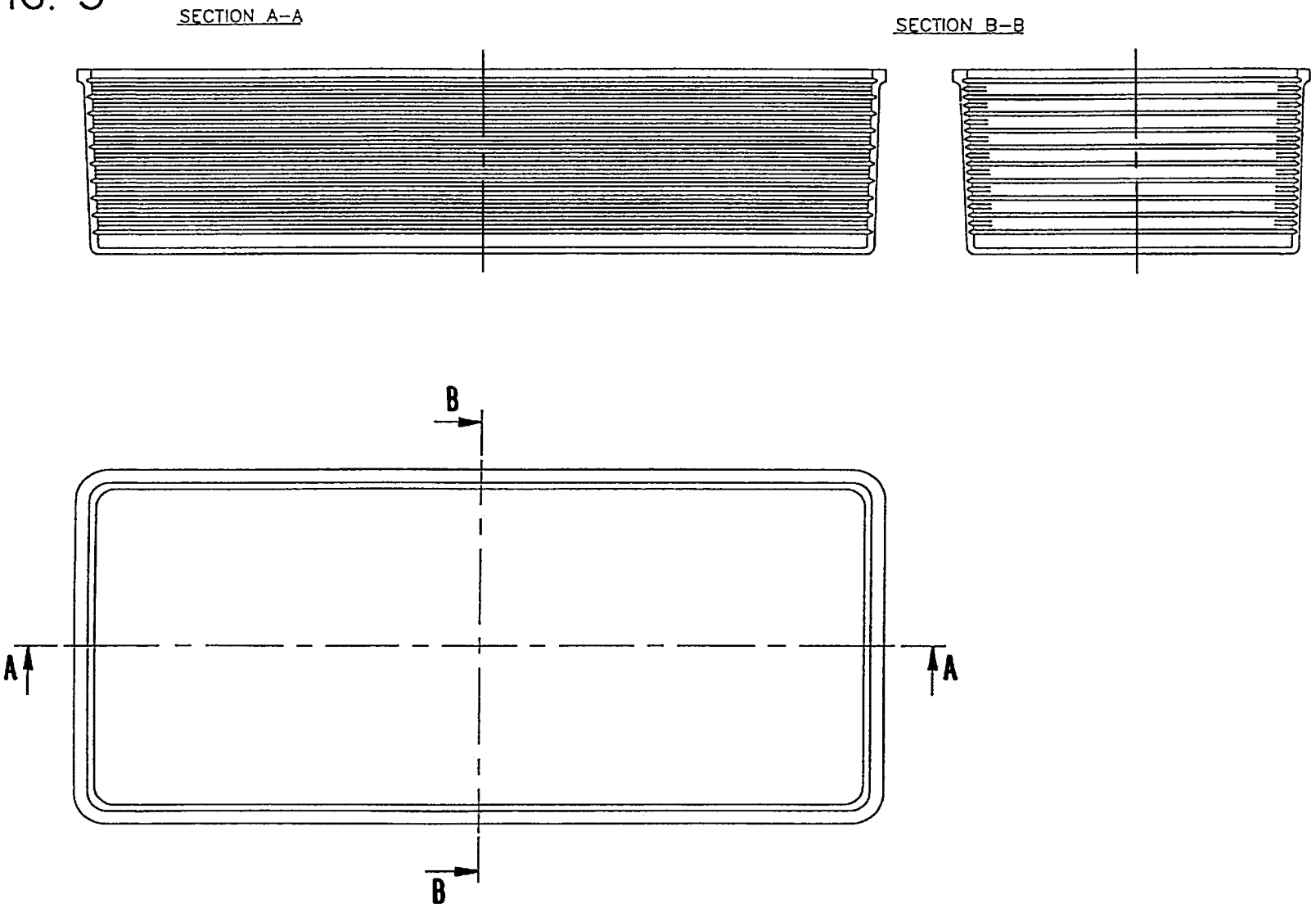
FIG. 3 is an overall view of a prior art boot.
Figure 4:
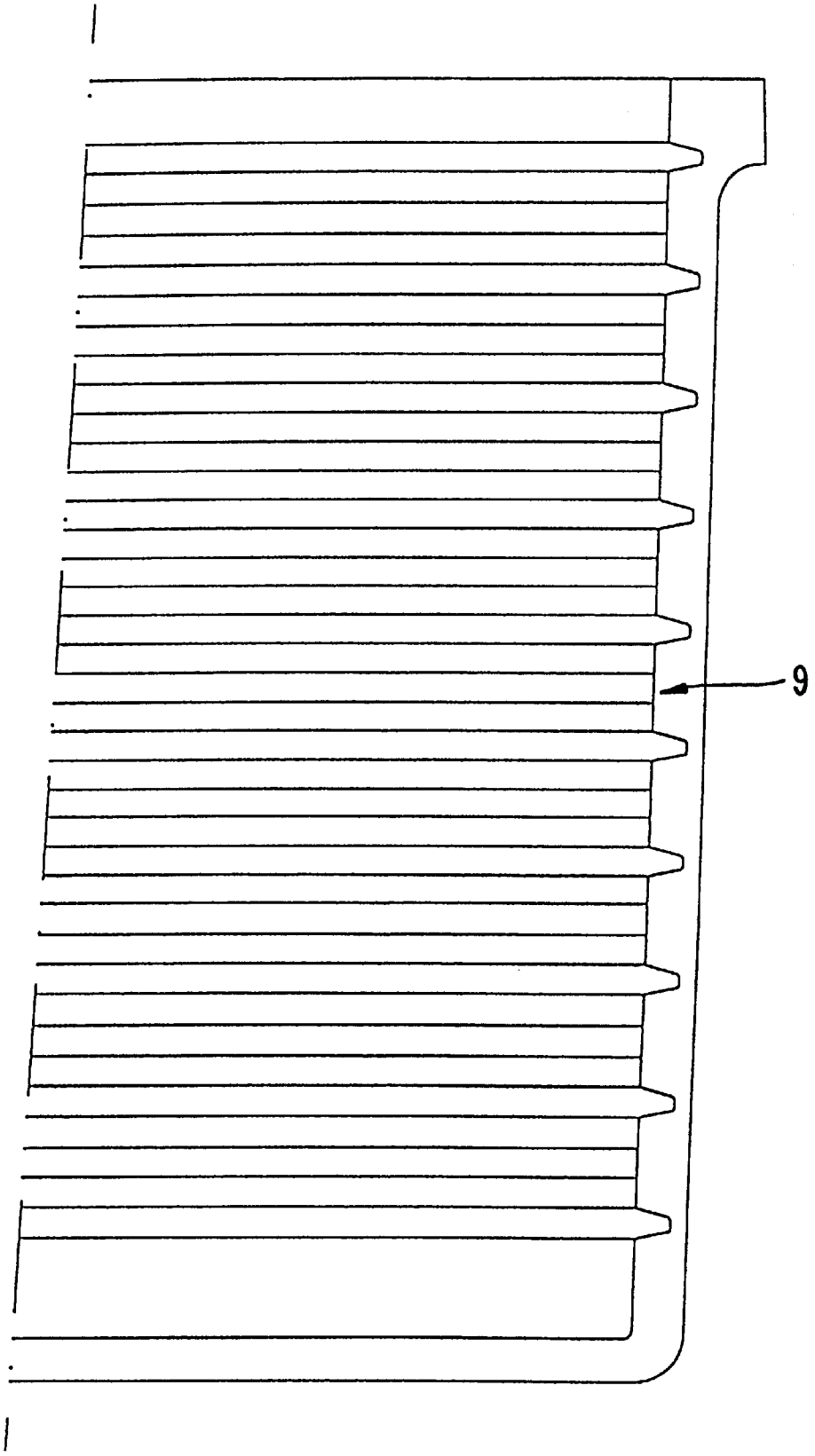
FIG. 4 is a cross sectional view of a prior art boot wall.

FIGS. 1 and 2 show two types of non-ballasted track systems, respectively. FIG. 1 shows an arrangement of a resilient pad 2 received within a rubber boot 1, a block 3 received within the boot 1 on top of the resilient pad 2, and a rail 7 attached to a top surface of the block 3. A second boot, resilient pad, block and rail arrangement is positioned across from the first arrangement such that a predetermined distance between the rails, i.e. track gauge, is established. Once the track gauge is established, concrete or grout 4 is poured around the boots of these arrangements, whereby upon curing of this concrete or grout 4, the boots become set therein and the track gauge is fixedly established. The track system of FIG. 2 is essentially the same as that of FIG. 1, except that a tie 6 is used in place of the block.

Figure 5:
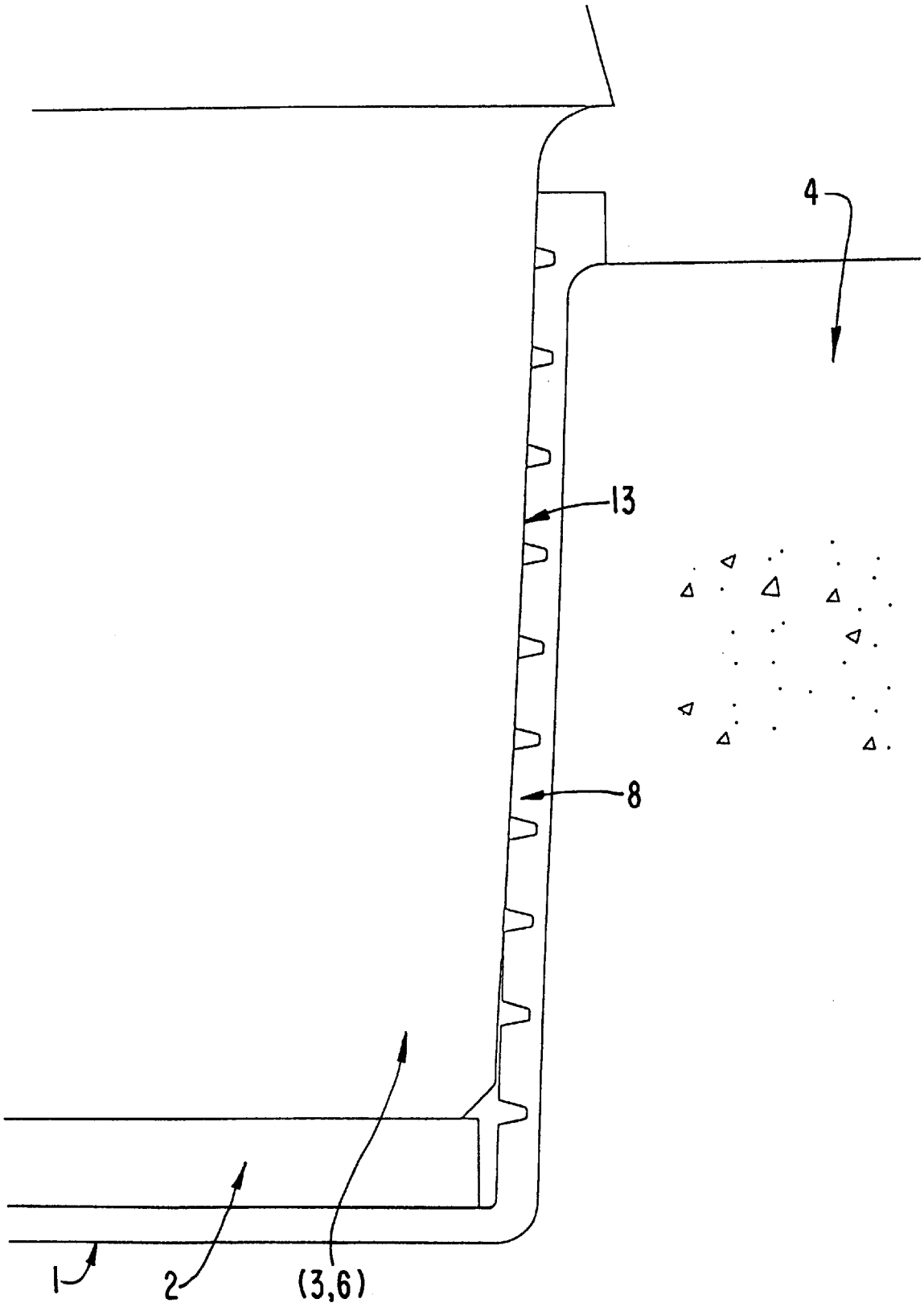
FIG. 5 is a cross sectional segmental view of a prior art non-ballasted track system.

In the prior art, before pouring the concrete or grout 4, the spacing between an external surface of the block or tie (3,6) and an internal surface of a boot wall 8 is small. Accordingly, when the concrete or grout 4 is poured it forces the wall 8 of the rubber boot 1 against the block or tie (3,6), whereby the aforementioned space between the block or tie (3,6) and the boot wall 8 is eliminated at least along a portion of the block or tie and boot wall. This is demonstrated in FIG. 5 by reference numeral 13.

This elimination of the space between the block or tie (3,6) and boot wall 8 does not prevent the designed deflection of the resilient pad 2 from being achieved when a static vertical load is applied to the block or tie (3,6). That is, the block or tie (3,6) will move downwardly under the vertical load until the designed deflection of the resilient pad 2 is achieved. The movement of the block or tie (3,6) downward will be slowed but not prevented by the progressively increasing compression and shear deformation of ribs 9 that are molded into the boot wall 8 and contact the block or tie (3,6). However, problems are encountered during dynamic loading of the block or tie (3,6).

Specifically, under the dynamic loading conditions prevailing in the track, where the wheels of passing trains subject the block or tie (3,6) to closely spaced loading and unloading cycles while wheel or rail defects generate vibrations within a wide frequency range, the elimination of the spacing between the block or tie (3,6) and the boot wall 8, i.e. the wedge effect or interface between the block or tie (3,6) and the boot wall 8, interferes with the elastic response of the track system. This results in a higher dynamic to static stiffness ratio, which can result in excessive noise and vibration being transmitted to the environment. The dynamic to static stiffness ratio can be decreased by employing a boot in accordance with the invention.

Figure 6:
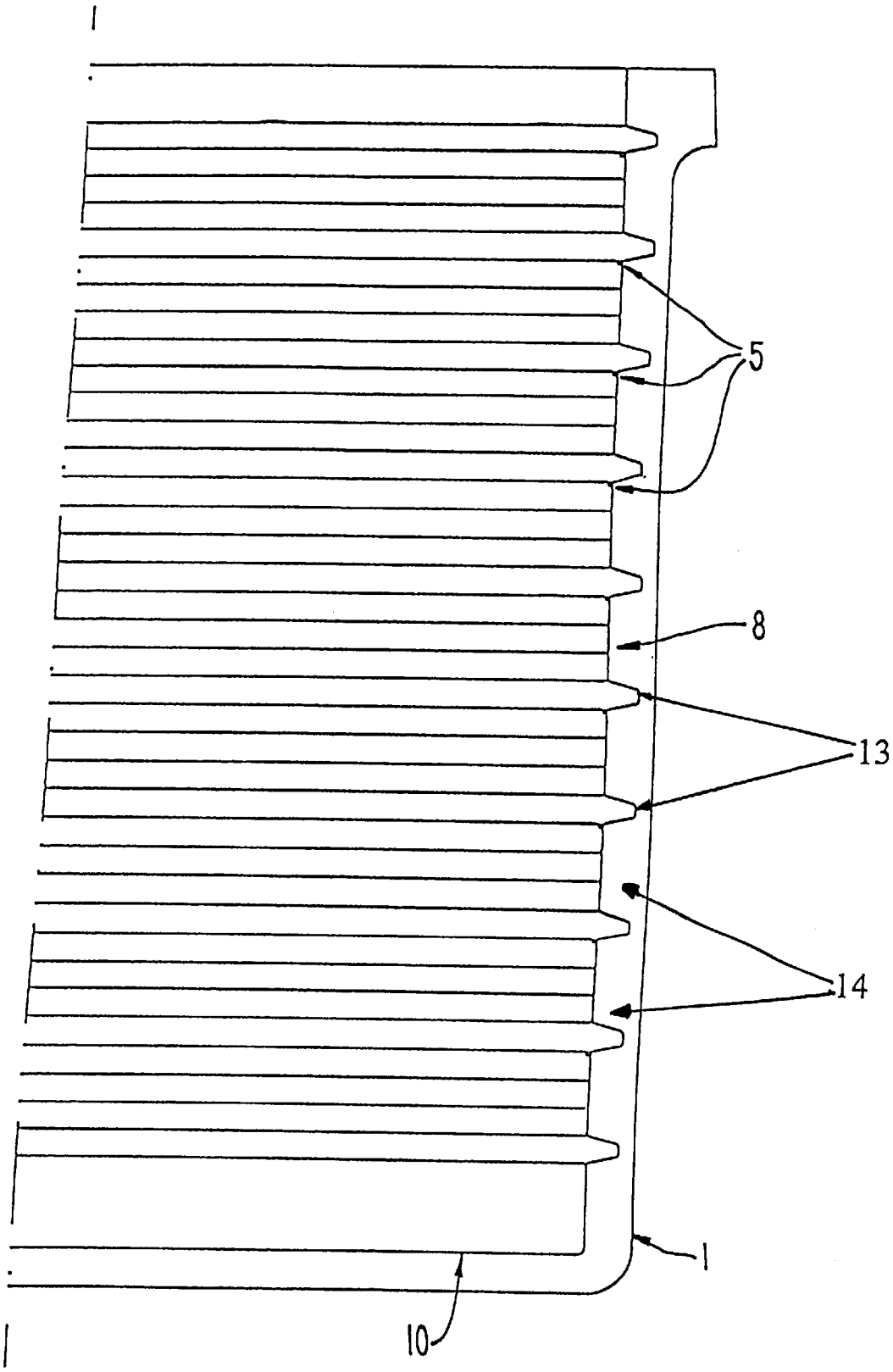
FIG. 6 is a cross sectional view of a boot wall of the present invention.

The boot of the invention is similar in all aspects to the prior art boot, except that spaced fins 5 project from the wall 8 of the boot 1 as shown in FIG. 6. Accordingly, the boot 1 is preferably rubber and has a bottom surface 10 with a peripheral wall 8 extending upwardly from the bottom surface 10. The wall tapers from its top end towards the bottom surface 10 and has fins 5 extending inwardly therefrom. More specifically, the peripheral wall 8 includes grooves 13 spaced therealong from the top of the peripheral wall 8 to the bottom of the peripheral wall 8. Accordingly, defined between these grooves 13 are ribs 14, and it is these ribs 14 from which the fins 5 extend.

Figure 7:
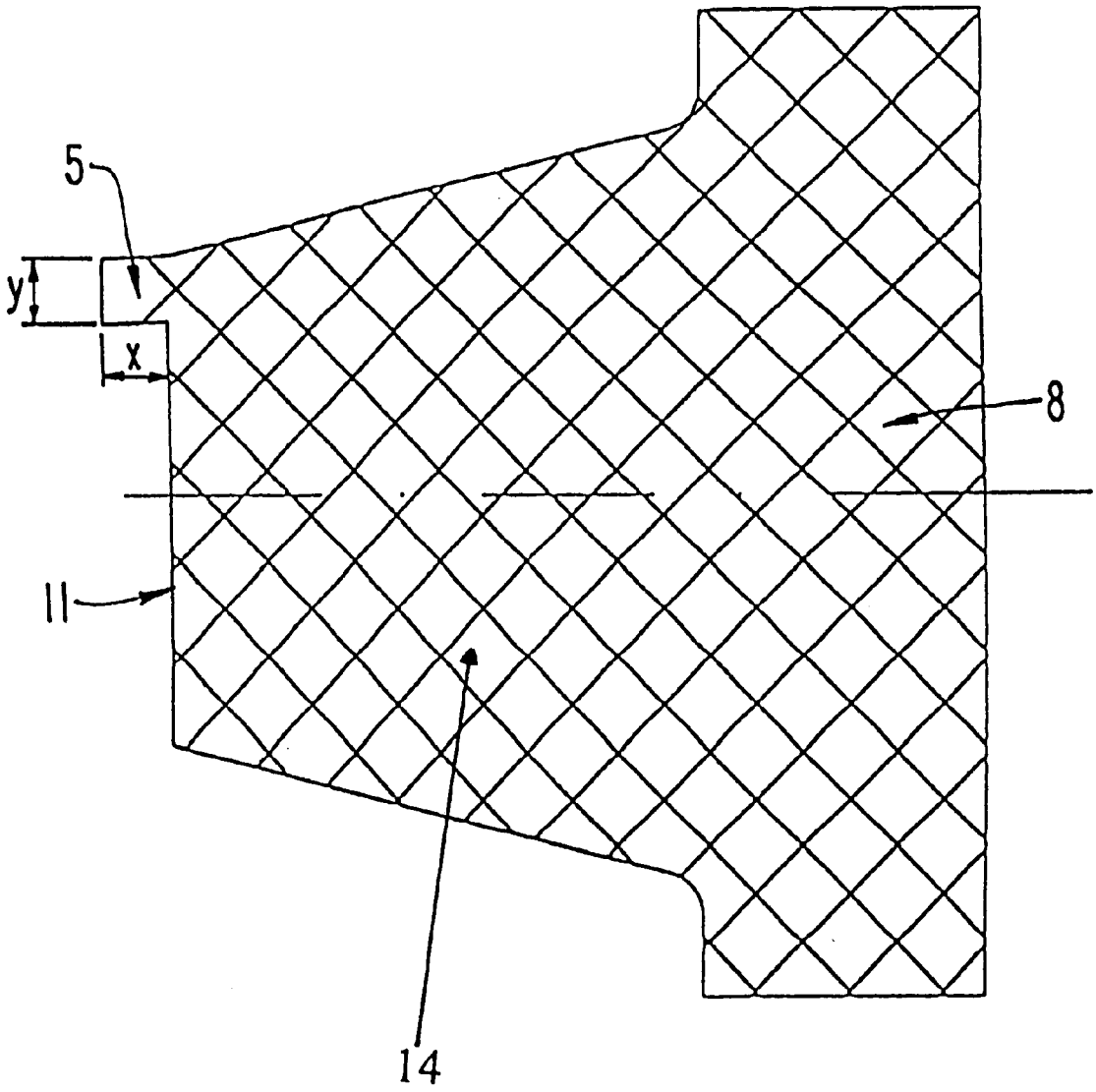
FIG. 7 is a detailed view of an internal boot fin.
Figure 8:
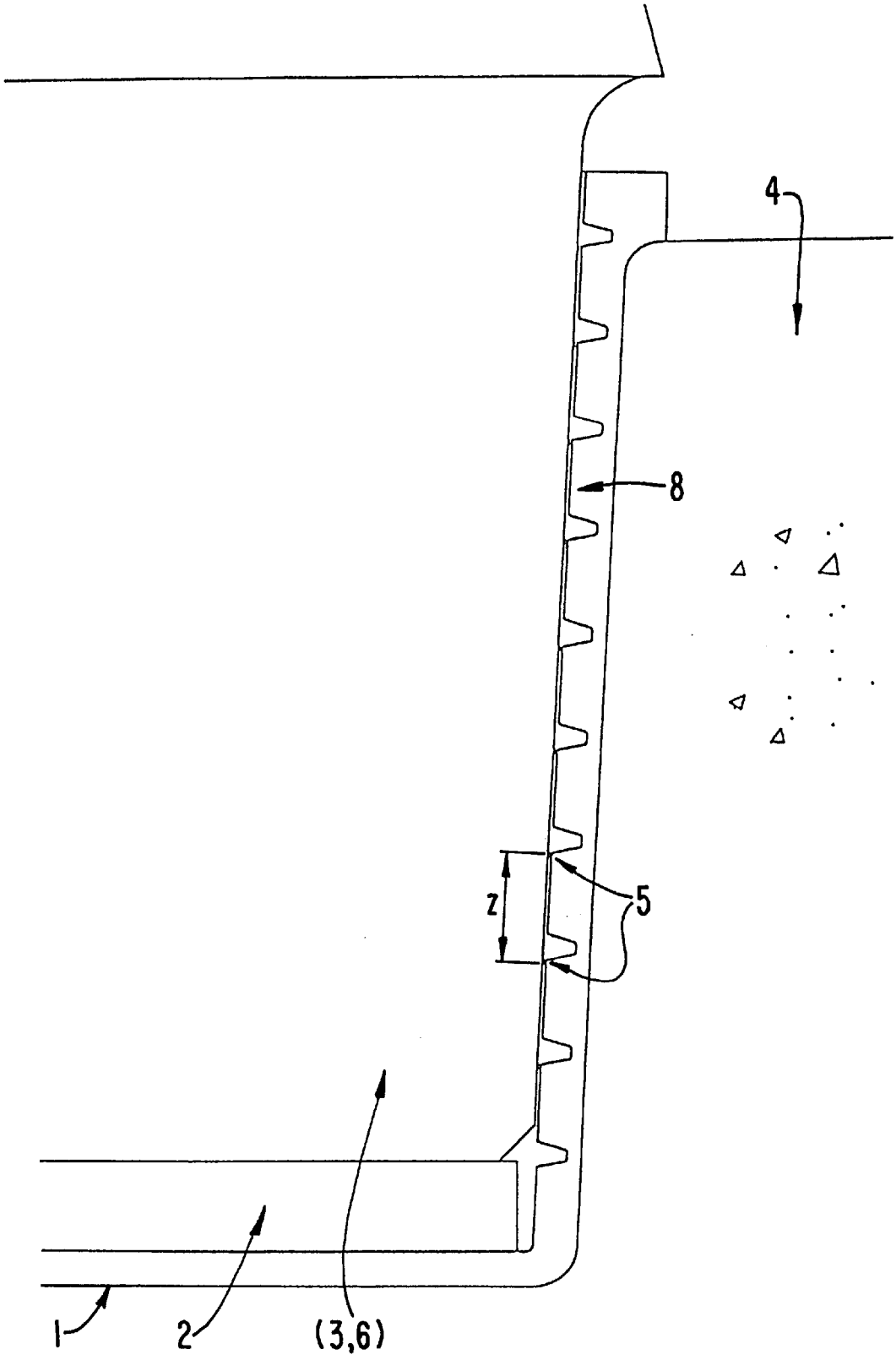
FIG. 8 is a cross sectional segmental view of a non-ballasted track system in accordance with the present invention.

FIG. 7 shows the dimensions of a fin 5. Each fin 5 protrudes a distance "x" from an inner surface 11 of the wall 8 that defines the ribs 14, which distance is from about 0.3 mm to about 1.5 mm, and preferably 0.5 mm. Distance "x" is measured along a direction that is perpendicular to the inner surface 11 of the wall 8. The thickness of the fin is shown as dimension "y" and is from about 0.3 mm to about 2.0 mm, and preferably 0.5 mm. Dimension "y" is measured along a direction that is perpendicular to distance "x" and parallel to the inner surface 11 of the wall 8. Also, the spacing between adjacent fins 5 is from about 7.0 mm to about 30.0 mm, and preferably 14.0 mm. This spacing, shown as dimension "z" in FIG. 8, is measured from the mid-point of one fin 5 to the mid-point of an adjacent fin 5 along a line that is parallel to dimension "y". Additionally, the boot 1 has a hardness of between 50–100 Shore A, and preferably 60–90 Shore A. The boot 1 of the present invention results in a lower dynamic to static stiffness ratio as compared to that of the prior art as follows.

As shown in FIG. 8, a resilient pad 2 is placed within the boot 1 and then a block or tie (3,6) is placed within the boot 1 on top of the resilient pad 2. The fins 5 serve to space the block or tie (3,6) from the wall 8 of the boot during pouring and curing of the concrete or grout 4. That is, the number, hardness and dimensions of the fins 5 are chosen such that they retain their integrity under the hydrostatic pressure exerted against the rubber boot 1 by the concrete or grout 4 during the pouring and curing thereof. Thus, the fins 5 of the present invention prevent the interface between the block or tie (3,6) and the boot wall 8, as exists in the prior art.

Figure 9:
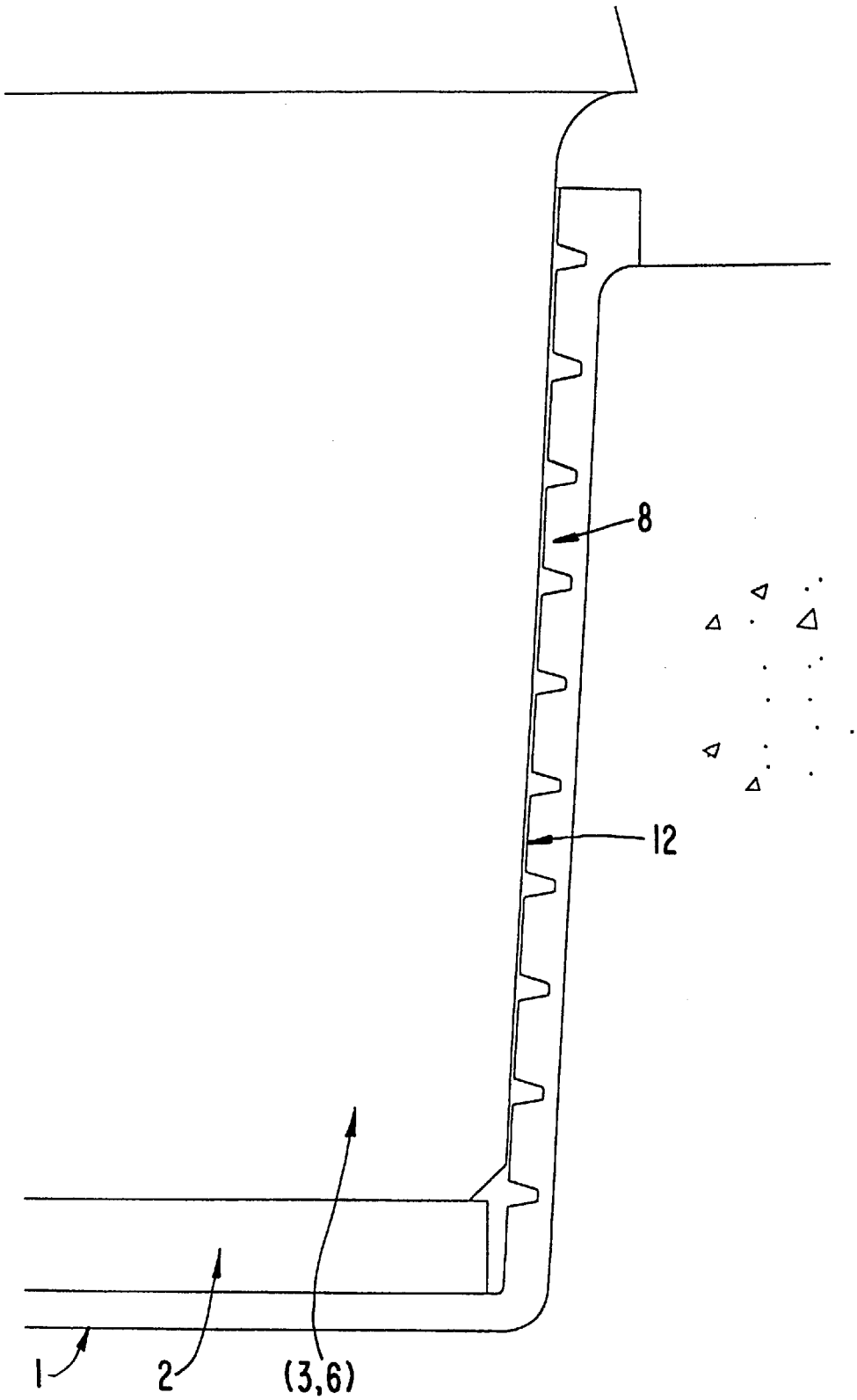
FIG. 9 is a cross sectional segmental view of a non-ballasted track system in accordance with the present invention after repeated loading cycles.

Also, the number, hardness and dimensions of the fins 5 are chosen such that they are rapidly crushed or abraded by the block or tie (3,6) moving inside the boot 1 under repeated loading cycles, such that after the fins 5 are abraded or otherwise removed from the wall 8 of the boot 1 a fit exists between the block or tie (3,6) and the boot 1 as shown in FIG. 9. As shown in FIG. 9 a clearance or spacing 12 exists between the block or tie (3,6) and the boot wall 8 along the entire surface of the block or tie and boot wall. Accordingly, because of this constant spacing 12 between the block or tie (3,6) and boot wall 8, the wedge effect realized in the prior art is not experienced. Thus, free vertical movement of the block or tie (3,6) and full designed deflection of the resilient pad is 2 allowed under dynamic loading resulting from trains traveling on the tracks. Accordingly, the dynamic to static stiffness ratio of the track system is easily lowered relative to that of the prior art track system without decreasing the lateral stability of the track system. Thus, the track system employing the boot of the invention is ensured to meet specified dynamic to static stiffness ratio limitations to limit noise and vibrations transmitted to the environment, while not experiencing any reduction in lateral stability.

Furthermore, the fins can be easily provided for by modifying an existing boot mold, and thereby limit the cost associated with producing the boot.

While a preferred embodiment of the invention has been illustrated and described, it will be obvious to those skilled in the art that various changes and modifications may be made therein without departing from the scope of the invention as defined in the appended claims.

What is claimed is:

1. A railway block boot, comprising:

a bottom surface;

a peripheral wall extending from said bottom surface and defining an open end, with said peripheral wall including ribs; and fins extending inwardly from said ribs.

2. The boot according to claim 1, wherein said fins extend peripherally around said peripheral wall and are spaced from one another along said peripheral wall in a direction extending from said bottom surface to said open end.

3. The boot according to claim 2, wherein said fins are spaced from one another by a distance of between 7.0 mm and 30.0 mm.

4. The boot according to claim 3, wherein said fins are spaced from one another by a distance of 14.0 mm.

5. The boot according to claim 1, wherein said fins extend inwardly from said ribs a distance of between 0.3 mm and 1.5 mm.

6. The boot according to claim 5, wherein said fins extend inwardly from said ribs a distance of 0.5 mm.

7. The boot according to claim 1, wherein said fins each have a thickness of between 0.3 mm and 2.0 mm.

8. The boot according to claim 7, wherein said fins each have a thickness of 0.5 mm.

9. The boot according to claim 1, wherein said fins have a hardness of between 50–100 Shore A.

10. The boot according to claim 9, wherein said fins have a hardness of between 60–90 Shore A.

11. The boot according to claim 1, wherein said peripheral wall tapers from said open end towards said bottom surface.

12. The boot according to claim 1, wherein said boot comprises rubber.

13. A railway system, comprising:

a boot having a bottom surface, a peripheral wall extending from said bottom surface and defining an open end, with said peripheral wall including ribs, and fins extending inwardly from said ribs; and a railway block or tie within said boot.

14. The railway system according to claim 13, wherein said fins extend peripherally around said peripheral wall and are spaced from one another along said peripheral wall in a direction extending from said bottom surface to said open end.

15. The railway system according to claim 14, wherein said fins are spaced from one another by a distance of between 7.0 mm and 30.0 mm.

16. The railway system according to claim 15, wherein said fins are spaced from one another by a distance of 14.0 mm.

17. The railway system according to claim 13, wherein said fins extend inwardly from said ribs a distance of between 0.3 mm and 1.5 mm.

18. The railway system according to claim 17, wherein said fins extend inwardly from said ribs a distance of 0.5 mm.

19. The railway system according to claim 13, wherein said fins each have a thickness of between 0.3 mm and 2.0 mm.

20. The railway system according to claim 19, wherein said fins each have a thickness of 0.5 mm.

21. The railway system according to claim 13, wherein said fins have a hardness of between 50–100 Shore A.

22. The railway system according to claim 21, wherein said fins have a hardness of between 60–90 Shore A.

23. The railway system according to claim 13, wherein said peripheral wall tapers from said open end towards said bottom surface, and said railway block or tie correspondingly tapers such that said fins contact said railway block or tie.

24. The railway system according to claim 13, and further comprising a resilient pad between said bottom surface and said railway block or tie, wherein said resilient pad supports said railway block or tie.

25. The railway system according to claim 13, wherein said boot comprises rubber.

26. The railway system according to claim 13, and further comprising a rail supported by said railway block or tie.

27. A railway block boot, comprising:

a bottom surface;

a peripheral wall extending from said bottom surface and defining an open end, with said peripheral wall including ribs; and fins extending inwardly from said ribs, wherein said fins extend inwardly from said ribs a distance of about 0.5 mm, said fins each have a thickness of about 0.5 mm, said fins are spaced from one another by a distance of about 14.0 mm, and said fins have a hardness of between 60–90 Shore A.

28. The boot according to claim 27, wherein said peripheral wall tapers from said open end towards said bottom surface.

29. The boot according to claim 28, wherein said boot comprises rubber.

30. A railway system, comprising:

a boot having a bottom surface, a peripheral wall extending from said bottom surface and defining an open end, with said peripheral wall including ribs, and fins extending inwardly from said ribs, wherein said fins extend inwardly from said ribs a distance of about 0.5 mm, said fins each have a thickness of about 0.5 mm, said fins are spaced from one another by a distance of about 14.0 mm, and said fins have a hardness of between 60–90 Shore A; and a railway block or tie within said boot.

31. The railway system according to claim 30, wherein said peripheral wall tapers from said open end towards said bottom surface, and said railway block or tie correspondingly tapers such that said fins contact said railway block or tie.

32. The railway system according to claim 31, and further comprising a resilient pad between said bottom surface and said railway block or tie, wherein said resilient pad supports said railway block or tie.

33. The railway system according to claim 32, wherein said boot comprises rubber.

34. The railway system according to claim 33, and further comprising a rail supported by said railway block or tie.

* * * * *